US005759115A

United States Patent [19]

Spoerl

[11] Patent Number: 5,759,115

[45] Date of Patent: Jun. 2, 1998

[54] INERTIA GOLF CLUB

[76] Inventor: Frederick H. Spoerl, 529 N. Juniper Bay Rd., Somers, Mont. 59932

[21] Appl. No.: 782,818

[22] Filed: Jan. 13, 1997

[51] Int. Cl.[6] ..... A63B 69/36

[52] U.S. Cl. ..... 473/349; 473/332; 473/333; 473/340

[58] Field of Search ..... 473/324, 332, 473/333, 340, 341, 349, 350

[56] References Cited

U.S. PATENT DOCUMENTS

| | | | |
|---|---|---|---|
| D. 232,371 | 8/1974 | Becker | 473/341 |
| 1,154,490 | 9/1915 | Davis | 473/329 |
| 5,078,398 | 1/1992 | Reed | 273/80 A |
| 5,100,146 | 3/1992 | Antonious | 273/80 A |
| 5,340,106 | 8/1994 | Ravaris | 273/80 A |
| 5,439,222 | 8/1995 | Kranenberg | 273/80 A |
| 5,551,694 | 9/1996 | Grim, Jr. et al. | 473/329 |

*Primary Examiner*—William M. Pierce

*Attorney, Agent, or Firm*—Patent & Trademark Services; Joseph H. McGlynn

[57] ABSTRACT

An improved golf club head, specifically for a putter, which has a conventional putting face on the front and two cantilevered fins connected on the back of the putter head. The fins are oriented perpendicularly to the putting face, extending to the back of the putter, so that one is connected adjacent the top of the putter head and the other adjacent the bottom of the putter head. The fins are partially connected to the putter along the tapered part of the fin, allowing the large part of the fin not to be directly attached to the putter's back face. The upper fin is connected to one end of the putter's back face and the lower fin is connected to the other end of the putter's back face, thereby locating the center of mass of the fin arrangement along the vertical center line of the putter's back face.

16 Claims, 1 Drawing Sheet

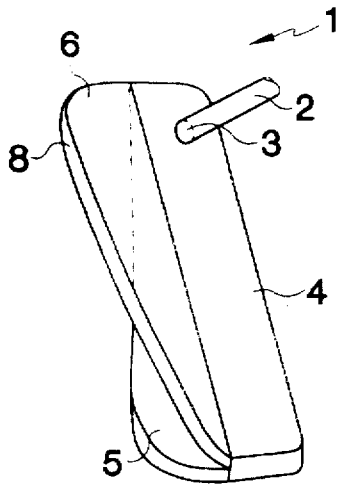
FIG. 1
FIG. 2
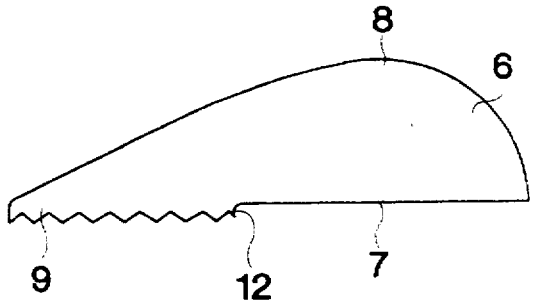
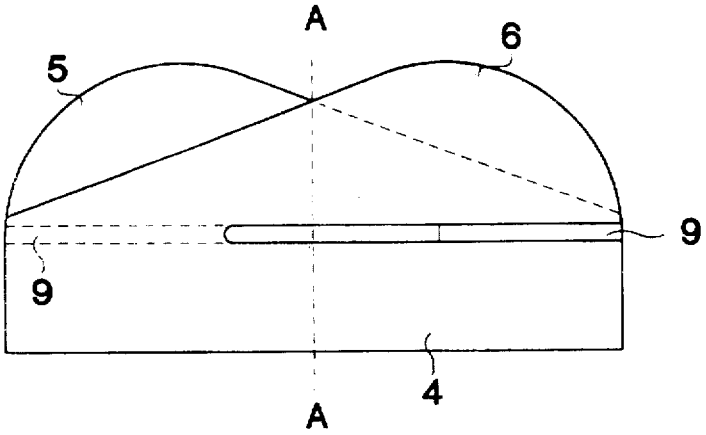
FIG. 3
FIG. 4
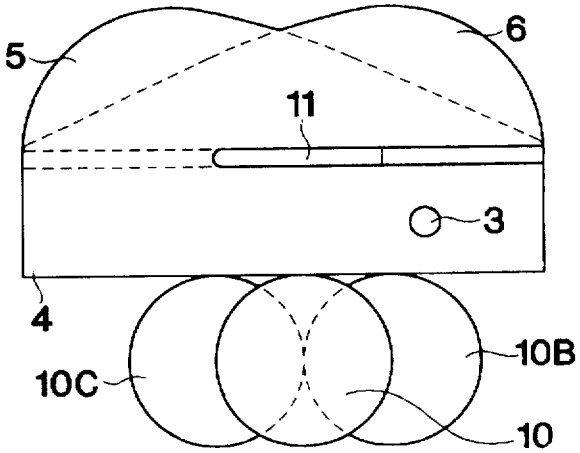

INERTIA GOLF CLUB

BACKGROUND OF THE INVENTION

This invention relates generally to golf clubs and, more particularly, to weighted putters with altered moments of inertia.

DESCRIPTION OF THE PRIOR ART

Numerous inventions relating to weighted golf clubs have been proposed in the prior art. Often, they seek to better balance putters for use in a plurality of angles. U.S. Pat. No. 5,439,222 discloses an improved putter in which a heel and toe weighted putter head, hosel, and shaft are configured such that the putter's mass is equally bisected by a vertical plane intersecting the heel and toe regions of the putter head and having the longitudinal axis of the shaft lie in that place. This configuration provides a table balanced feature to the golf putter, which is not defeated by many hosel positions and shaft lie angles.

U.S. Pat. No. 5,340,106 discloses a specification for a putter with an improved moment of inertia and improved sole to reduce the adverse effects of grounding the club head. The putter increases peripheral weighting relative to the center of gravity by incorporating a non-rectangular shaped face. Increasing the peripheral weighting increases the putter moment of inertia thereby reducing the adverse effects of striking the ball away from the center of gravity.

U.S. Pat. No. 5,100,146 discloses a putter type golf club head including a rear cavity defined by heel and toe weights including secondary weights positioned on the top surface of the heel and toe weight masses between the cavity and the extremities of the golf club. The invention contemplates varying the size and height of the secondary weight members to provide precise weight adjustment thereon.

U.S. Pat. No. 5,078,398 discloses an improved golf putter club in which the club head, hosel, shaft and grip are so configured that the club's total weight is perfectly centered and balanced about the club's shaft axis, resulting in multi-directional stability, i.e., infinite balancing, against any static forces causing the putter club head to rotate off line about the shaft, grip, and hosel axis. Such rotational stability eliminates any inherent twisting forces of the putter head during use.

Most of the prior art inventions seek only to improve the balancing of the club head, thereby producing a club head reaction to the user's motion that is true and accurate, that is, without mechanical errors. There remains a need for a device which compensates for and reduces the effect of human error in a swinging motion in the form of off-center contact with the golf ball.

SUMMARY OF THE INVENTION

The present invention comprises an improved golf club head, specifically for a putter, which has a conventional putting face on the front and two cantilevered fins connected on the back of the putter head. The fins are oriented perpendicularly to the putting face, extending to the back of the putter, so that one is connected adjacent the top of the putter head and the other adjacent the bottom of the putter head. The fins are partially connected to the putter along the tapered part of the fin, allowing the large part of the fin not to be directly attached to the putter's back face. The upper fin is connected to one end of the putter's back face and the lower fin is connected to the other end of the putter's back face, thereby locating the center of mass of the fin arrangement along the vertical center line of the putter's back face.

In use, the putter head is used as a conventional putter, striking a golf ball along the front face of the putter head. If the golf ball contacts the club face in a position that is not on the vertical center line of the club's face, thereby introducing a torquing force to the club head, the inertial effects of the off-center mass of one of the cantilevered fins counters the torquing force, thus preventing the club face from twisting. In this way, the club forces the ball to travel a straight path in the direction of the club's motion. If the ball contacts the vertical center line of the club's face, the inertial effects of the off-center mass of the two fins neutralize one another, thereby causing the club to act as a normal putter.

Accordingly, it is an object of this invention to construct a golf club head for a putter that allows the club to function as a conventional putter, driving a golf ball when contacted by the front face.

It is a further object of this invention to allow the putting action to direct a struck golf ball to travel in a motion that is directly perpendicular to the club's face when struck along the center line of the club's face.

Finally, it is an object of this device that the putter direct a struck golf ball to travel in the direction of the club's motion prior to contact even when the ball is not contacted along the center line of the club's face.

BRIEF DESCRIPTION OF THE DRAWINGS

FIG. 1 shows a perspective view of the invention as it is attached to a club shaft.

FIG. 2 shows a top view of one of the fins.

FIG. 3 shows a top view of the invention.

FIG. 4 shows a top view of the invention as it contacts a golf ball in three locations.

DESCRIPTION OF THE PREFERRED EMBODIMENT

Referring now to the drawings, there is shown in FIG. 1 the present invention 1 comprising a golf club head made of a front putting section 4 and an upper fin 6 and a lower 5 fin attached to the back of the putting section 4. A conventional club shaft 2 may be connected to the device in any standard fashion at a circular opening 3 in the putting section 4. The putting face 4 is not essential to the invention and therefore may be any normal putting face and have any characteristics pertaining there to, such as angling or grooving.

The two fins 5, 6 are identical in shape with a small depth and form any normal fin shape. As shown in FIG. 2 (note only fin 6 is shown in FIG. 2, however fin 5 is identical to fin 6) the fins 5, 6 are nearly triangular in shape, with a surface 7 that is approximately 75% of the length of the putter section 4 and a large curve 8 that extends towards one end of the fin. It should be noted that the fins 5, 6 are shown as triangular, however, other shapes can be used for the fins.

Attached to the end of fin 5, 6 opposite the end with the curve 8 (i.e. the smaller end of the fin) is a connecting piece 9 which begins at the point of the fin 5, 6 and continues for a length that is approximately ¼ of the length of the long face or surface 7. The connecting piece 9 is rectangular in shape, although other shapes could be used.

The fins 5, 6 are connected to the putting section 4 via the connecting pieces 9 as shown in FIG. 1 so that the large curve 8 of the upper fin 6 is nearest to one end of the putting section 4 while the large curve 8 of the lower fin 5 is nearest to the other end of the putting section 4. In this way, the fins 5, 6 are mirrored about a horizontal line AA through the center line of the putting section 4, as shown in FIG. 3.

FIG. 4 shows that in use, the club head strikes a conventional golf ball 10 at the putting face 4 in a normal putting motion. When the ball 10 contacts the putting face 4, both the upper fin 6 and lower fin 5, which have gathered momentum as the club is swung, have a tendency to continue forward at the unattached ends due to the larger mass of the fins at this end. The continuation of movement by the upper fin 6 will produce a clockwise torquing moment about the vertical center line of the putting face 4 due to the larger mass of the fin on one end. The lower fin 5 will produce a counterclockwise torquing moment about the center line by the same effect. When the ball 10 contacts the club along the vertical center line of the putting section 4, the effects of the two fins 5, 6 will be neutralized, thereby producing no net torquing moment about the center line.

When the ball 10C contacts the club face 4 in a position away from the center line, the force of the off-center contact causes a torquing moment which tends to rotate the club head in a clockwise motion around the vertical center line, when the contact position is at the end of club head 4 opposite the end with the hole 3 for the shaft 2. Furthermore, the force exerted by contact of the ball 10C onto the club head will also tend to slow down the end opposite the end with the hole 3. However, the momentum of the lower fin 5 will not be completely dissipated by this contact force, due to the larger mass on one end of the fin. This extra mass will tend to move the center of mass of the fin 5 in the initial direction of club motion (towards the ball 10C) even as the club head 4 as a whole is slowed. This continuation of motion by the lower fin 5 will show itself in the form of counterclockwise angular momentum about the vertical center line of the club head 4. The angular momentum will tend to oppose the clockwise angular momentum generated by the torquing moment of the contact between the putting face 4 and the ball 10C, thereby preventing the club head 4 from rotating about the center line. Thus, the lower fin 5 causes opposition to the club head's tendency to rotate when struck by the ball 10C.

Similar logic and reasoning may be used to show that when a ball 10B contacts the club head 4 in a position that is on the same side of the head as the hole for shaft attachment 3, the upper fin 6 will undergo a similar process which will tend to oppose the club's tendency to rotate. In this way, the fins 5, 6 prevent the club head 4 from rotating when a ball 10B,10C contacts the club head 4 in a position away from the vertical center line of the putting face.

While the invention described herein has contained the assumptions that the shaft 2 location is at one end of the putter head and that the center of gravity of the putter section 4 is found along the horizontal center line AA, it is to be understood that the scope of this invention extends to cases wherein the shaft is located in other places and/or wherein the center of gravity is found in other locations. The concept of the fin 5, 6 momentum and movement to counteract the torquing force introduced by contact with the ball 10 is identical in such a circumstance, though the exact orientation and weighting of the fins 5, 6 might be altered for such an eventuality.

The composition and construction of the putter head and fin assembly are not essential to the workings of this invention; it is therefore to be understood that the device may constructed using a variety of materials, so long as they perform the functions and actions described herein. The putting section 4 may be manufactured in a similar fashion to any normal putter head and may feature all characteristics normally associated with a putter head. The fins 5, 6 and connecting pieces 9 are best manufactured out of a strong and fairly dense material. Numerous metals such as steel, may be acceptable for these components, though other materials might be used as well. The fins 5, 6 and connecting pieces 9 are best constructed as continuous pieces to allow ideal performance, though they might be made separately and joined by any conventional method.

Although the Inertia Golf Club and the means of using the same according the present invention have been described in the foregoing specification with considerable detail, it is to be understood that modifications may be made to the invention which do not exceed the scope of the appended claims, and modified forms of the present invention done by others skilled in the art to which the invention pertains will be considered infringements of the invention when those modified forms fall within the claimed scope of this invention.

What I claim as my invention is:

1. A golf club head comprising:

said head having a front face and a back surface, at least a pair of fins attached to said back surface, each of said fins being substantially flat and having a peripheral edge with a planar face and a curved surface, said planar face being attached adjacent said back surface, and said curved surface being remote from said back surface, each of said fins being attached to said back surface at only one end of the planar face, and wherein said fins are mounted in vertically spaced relation to each other on said back surface.

2. The golf club head as claimed in claim 1, wherein each of said fins have two ends, said fins being larger at one end than the other end.

3. The golf club head as claimed in claim 1, wherein each of the fins have a large end and a small end, and the larger end of one of said fins overlaps the smaller end of another fin.

4. The golf club head as claimed in claim 1, wherein one of said fins is attached to said back surface and extends approximately across the entire back surface, and another of said fins is attached to said back surface and extends approximately across the entire back surface.

5. The golf club head as claimed in claim 1, wherein each said fin extends across said back surface, and wherein said first fin extends in a different plane than said second fin.

6. The golf club head as claimed in claim 5, wherein said planes are parallel planes.

7. A golf club head comprising:

said head having a front face and a back surface, at least a pair of fins attached to said back surface, each of said fins having a planar face and a curved surface, said planar face being attached adjacent said back surface, and said curved surface being remote from said back surface, each of said fins being attached to said back surface at only one end, and wherein each of said fins have two ends, said fins being larger at one end than the other end, and wherein said fins are attached to said back surface at an end opposite from said large end of said fins, and wherein the larger end of one of said fins overlaps the smaller end of another fin.

8. The golf club head as claimed in claim 7, wherein said large end of each fin is mounted at opposite ends of said club head.

9. The golf club head as claimed in claim 7, wherein one of said fins is attached to said back surface and extends approximately across the entire back surface, and another of said fins is attached to said back surface and extends approximately across the entire back surface.

10. The golf club head as claimed in claim 7, wherein each said fin extends across said back surface, and wherein said first fin extends in a different plane than said second fin.

11. The golf club head as claimed in claim 10, wherein said planes are spaced vertically along said back surface.

12. The golf club head as claimed in claim 10, wherein said planes are parallel planes.

13. A golf club head comprising:

said head having a front face and a back surface, at least a first and a second fin attached to said back surface, each of said fins having a planar face and a curved surface, said planar face being attached adjacent said back surface, and said curved surface being remote from said back surface, each of said fins being attached to said back surface at only one end, and wherein each of said fins have two ends, said fins being larger at one end and smaller at the other end, and wherein said larger end of each said fin being spaced from said back surface by a slot, and wherein each said fin extends across said back surface, and wherein said first fin extends in a different plane than said second fin, and wherein said planes are spaced vertically along said back surface.

14. The golf club head as claimed in claim 12, wherein the larger end of one of said fins overlaps the smaller end of another fin.

15. The golf club head as claimed in claim 12, wherein one of said fins is attached to said back surface and extends approximately across the entire back surface, and another of said fins is attached to said back surface and extends approximately across the entire back surface.

16. The golf club head as claimed in claim 13, wherein said planes are parallel planes.

* * * * *

UNITED STATES PATENT AND TRADEMARK OFFICE

CERTIFICATE OF CORRECTION

PATENT : 5,759,115

DATED : June 2, 1998

INVENTOR(S) : Frederick H. Spoerl

It is certified that error appears in the above-identified patent and that said Letters Patent is hereby corrected as shown below:

The title page, showing the illustrative Figure should be deleted and substitute therefor the attached title page.

In the drawings, sheet 1 should be deleted to be substituted with the attached sheet 1, as shown on the attached page.

US005759115A

United States Patent [19]

Spoerl

[11] Patent Number: 5,759,115

[45] Date of Patent: Jun. 2, 1998

[54] INERTIA GOLF CLUB

[76] Inventor: Frederick H. Spoerl, 529 N. Juniper Bay Rd., Somers, Mont. 59932

[21] Appl. No.: 782,818

[22] Filed: Jan. 13, 1997

[51] Int. Cl.[6] ..... A63B 69/36

[52] U.S. Cl. ..... 473/349; 473/332; 473/333; 473/340

[58] Field of Search ..... 473/324, 332, 473/333, 340, 341, 349, 350

[56] References Cited

U.S. PATENT DOCUMENTS

| | | | |
|---|---|---|---|
| D. 232,371 | 8/1974 | Becker | 473/341 |
| 1,154,490 | 9/1915 | Davis | 473/329 |
| 5,078,398 | 1/1992 | Reed | 273/80 A |
| 5,100,146 | 3/1992 | Antonious | 273/80 A |
| 5,340,106 | 8/1994 | Ravaris | 273/80 A |
| 5,439,222 | 8/1995 | Kranenberg | 273/80 A |
| 5,551,694 | 9/1996 | Grim, Jr. et al. | 473/329 |

*Primary Examiner*—William M. Pierce
*Attorney, Agent, or Firm*—Patent & Trademark Services; Joseph H. McGlynn

[57] ABSTRACT

An improved golf club head, specifically for a putter, which has a conventional putting face on the front and two cantilevered fins connected on the back of the putter head. The fins are oriented perpendicularly to the putting face, extending to the back of the putter, so that one is connected adjacent the top of the putter head and the other adjacent the bottom of the putter head. The fins are partially connected to the putter along the tapered part of the fin, allowing the large part of the fin not to be directly attached to the putter's back face. The upper fin is connected to one end of the putter's back face and the lower fin is connected to the other end of the putter's back face, thereby locating the center of mass of the fin arrangement along the vertical center line of the putter's back face.

16 Claims, 1 Drawing Sheet

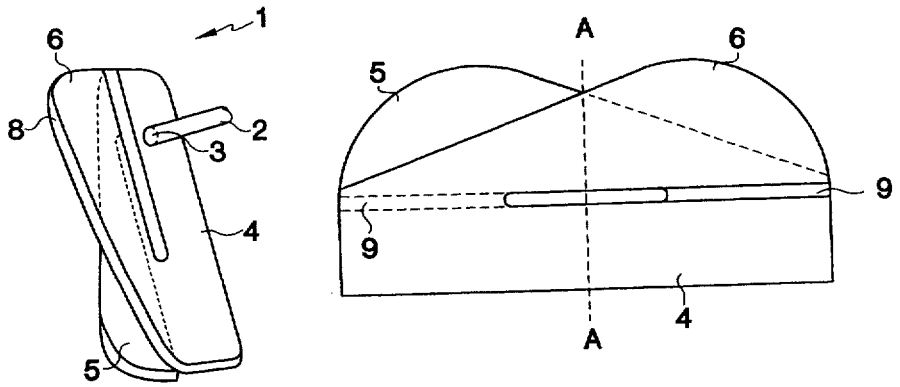

UNITED STATES PATENT AND TRADEMARK OFFICE

CERTIFICATE OF CORRECTION

PATENT NO. : 5,759,115

DATED : June 2, 1998

INVENTOR(S) : Spoerl

It is certified that error appears in the above-identified patent and that said Letters Patent is hereby corrected as shown below:

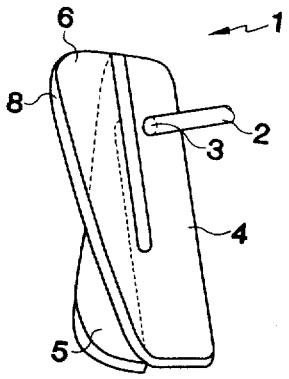

FIG. 1

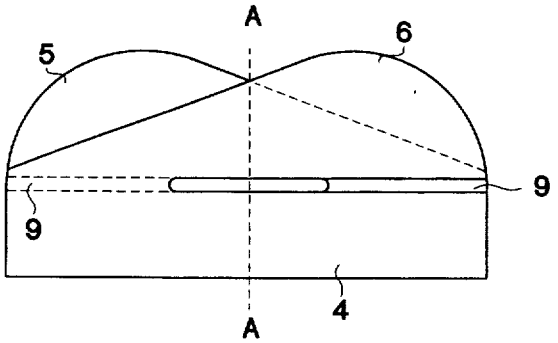

FIG. 3

Signed and Sealed this

Tenth Day of November 1998

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,759,115
DATED : Jun. 2, 1998
INVENTOR(S) : Spoerl

It is certified that error appears in the above-identified patent and that said Letters Patent is hereby corrected as shown below:

The title page should be deleted to appear as per attached title page.

Please delete drawing sheets 1 of 1 and substitute drawing sheets 1 of 1 as per attached.

Signed and Sealed this

Sixteenth Day of February, 1999

*Attest:*

*Acting Commissioner of Patents and Trademarks*

*Attesting Officer*

US005759115A

United States Patent [19]

Spoerl

[11] Patent Number: 5,759,115

[45] Date of Patent: Jun. 2, 1998

[54] INERTIA GOLF CLUB

[76] Inventor: Frederick H. Spoerl, 529 N. Juniper Bay Rd., Somers, Mont. 59932

[21] Appl. No.: 782,818

[22] Filed: Jan. 13, 1997

[51] Int. Cl.[6] ..... A63B 69/36

[52] U.S. Cl. ..... 473/349; 473/332; 473/333; 473/340

[58] Field of Search ..... 473/324, 332, 473/333, 340, 341, 349, 350

[56] References Cited

U.S. PATENT DOCUMENTS

| | | | |
|---|---|---|---|
| D. 232,371 | 8/1974 | Becker | 473/341 |
| 1,154,490 | 9/1915 | Davis | 473/329 |
| 5,078,398 | 1/1992 | Reed | 273/80 A |
| 5,100,146 | 3/1992 | Antonious | 273/80 A |
| 5,340,106 | 8/1994 | Ravaris | 273/80 A |
| 5,439,222 | 8/1995 | Kranenberg | 273/80 A |
| 5,551,694 | 9/1996 | Grim, Jr. et al. | 473/329 |

*Primary Examiner*—William M. Pierce
*Attorney, Agent, or Firm*—Patent & Trademark Services; Joseph H. McGlynn

[57] ABSTRACT

An improved golf club head, specifically for a putter, which has a conventional putting face on the front and two cantilevered fins connected on the back of the putter head. The fins are oriented perpendicularly to the putting face, extending to the back of the putter, so that one is connected adjacent the top of the putter head and the other adjacent the bottom of the putter head. The fins are partially connected to the putter along the tapered part of the fin, allowing the large part of the fin not to be directly attached to the putter's back face. The upper fin is connected to one end of the putter's back face and the lower fin is connected to the other end of the putter's back face, thereby locating the center of mass of the fin arrangement along the vertical center line of the putter's back face.

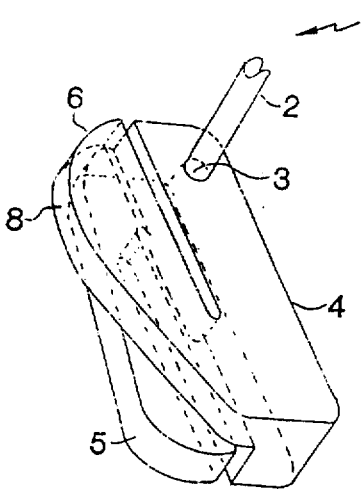

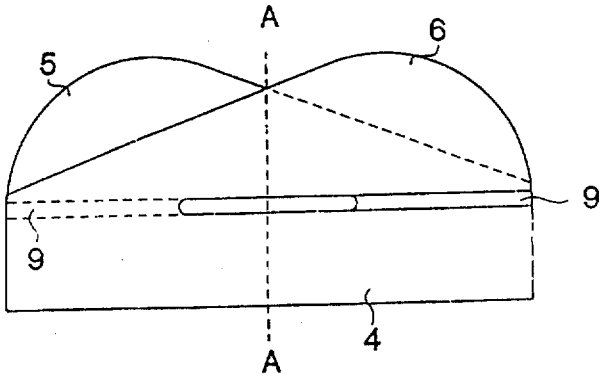

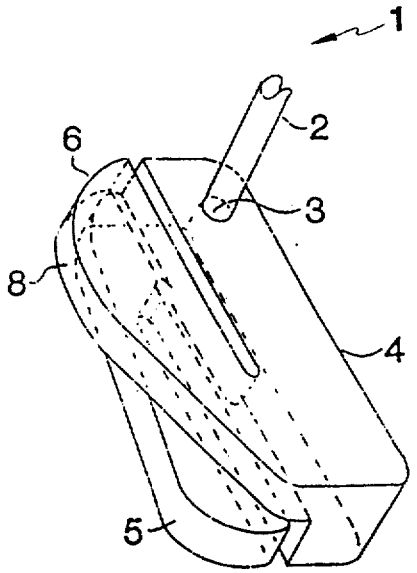
FIG. 1
FIG. 2
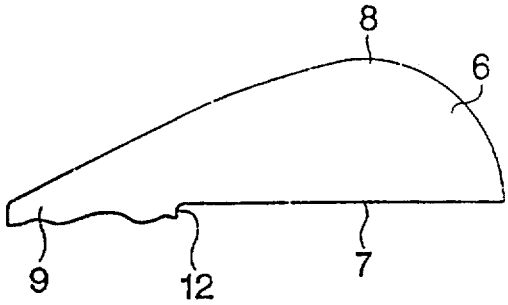
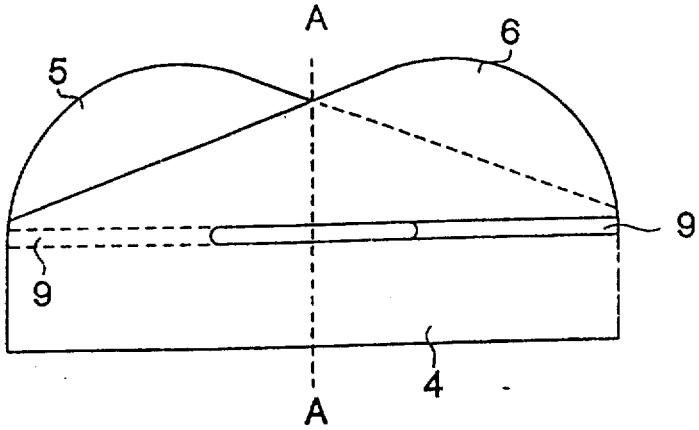
FIG. 3
FIG. 4
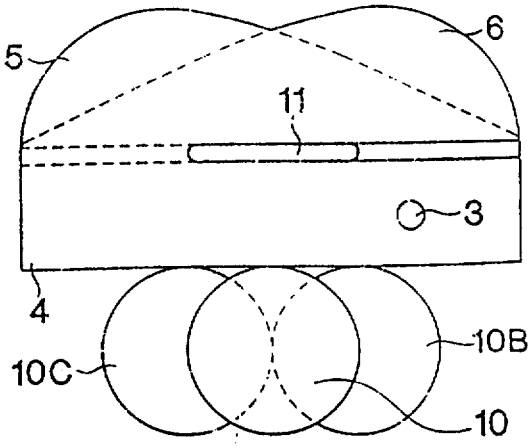

16 Claims, 1 Drawing Sheet